US011085458B1

(12) United States Patent
Yandle, II et al.

(10) Patent No.: US 11,085,458 B1
(45) Date of Patent: Aug. 10, 2021

(54) LOW PROFILE OVERHEAD BEARING ASSEMBLY FOR PUMP BEARING ASSEMBLY

(71) Applicant: S. Elwood Yandle, II, New Orleans, LA (US)

(72) Inventors: S. Elwood Yandle, II, New Orleans, LA (US); S. Elwood Yandle, III, Belle Chasse, LA (US)

(73) Assignee: S. Elwood Yandle, II, New Orleans, LA (US)

( * ) Notice: Subject to any disclaimer, the term of this patent is extended or adjusted under 35 U.S.C. 154(b) by 39 days.

(21) Appl. No.: 16/664,345

(22) Filed: Oct. 25, 2019

Related U.S. Application Data

(60) Provisional application No. 62/750,659, filed on Oct. 25, 2018.

(51) Int. Cl.

| | |
|---|---|
| ***F04D 29/049*** | (2006.01) |
| ***F04D 29/046*** | (2006.01) |
| ***F04D 29/10*** | (2006.01) |
| ***F04D 29/043*** | (2006.01) |
| ***F04D 29/60*** | (2006.01) |

(52) U.S. Cl.
CPC ..... *F04D 29/049* (2013.01); *F04D 29/043* (2013.01); *F04D 29/046* (2013.01); *F04D 29/10* (2013.01); *F04D 29/106* (2013.01); *F04D 29/605* (2013.01)

(58) Field of Classification Search
CPC ..... F04D 29/086; F04D 29/106; F04D 29/12; F04D 29/126; F04D 29/08; F04D 29/10; F04D 29/046; F04D 29/0462; F04D 29/049; F04D 29/605; F16J 15/34; F16C 17/04; F04B 29/043
USPC ..... 417/424.1
See application file for complete search history.

(56) References Cited

U.S. PATENT DOCUMENTS

| | | | | |
|---|---|---|---|---|
| 5,327,961 | A * | 7/1994 | Mills | E21B 33/085 166/68.5 |
| 5,639,227 | A * | 6/1997 | Mills | E21B 33/085 277/322 |
| 6,695,480 | B1 | 2/2004 | Ramsay et al. | |
| 9,347,488 | B2 | 5/2016 | Thoma et al. | |
| 9,394,903 | B2 | 7/2016 | Jablonski et al. | |
| 2006/0010646 | A1 | 1/2006 | Bushey | |
| 2007/0012543 | A1 | 1/2007 | Kelley et al. | |
| 2009/0283974 | A1 | 11/2009 | Groom et al. | |
| 2012/0068413 | A1 | 3/2012 | Putt et al. | |

(Continued)

FOREIGN PATENT DOCUMENTS

| | | |
|---|---|---|
| WO | 2001004503 | 1/2001 |
| WO | 2001053713 | 7/2001 |

*Primary Examiner* — Bryan M Lettman
(74) *Attorney, Agent, or Firm* — Garvey, Smith & Nehrbass, Patent Attorneys, L.L.C.; Seth M. Nehrbass; Charles C. Garvey, Jr.

(57) ABSTRACT

An improved pump and sealing assembly having particular utility to vertically extending pumps/pump shafts provides an arrangement that enables field repair as opposed to requiring travel of the host vessel to a shipyard. The apparatus includes an adapter housing that is configured to provide easy access to set screws that enable field disassembly. This adapter housing carries a sleeve and a bearing. The adapter housing can be fitted to a pump seal assembly that can include a mechanical seal and under bearing assembly.

18 Claims, 6 Drawing Sheets

(56) References Cited

U.S. PATENT DOCUMENTS

| | | | |
|---|---|---|---|
| 2015/0167671 | A1 | 6/2015 | Jablonski et al. |
| 2016/0130878 | A1 | 5/2016 | Cobern |

* cited by examiner

LOW PROFILE OVERHEAD BEARING ASSEMBLY FOR PUMP BEARING ASSEMBLY

CROSS-REFERENCE TO RELATED APPLICATIONS

Priority of our U.S. Provisional Patent Application Ser. No. 62/750,659, filed 25 Oct. 2018, incorporated by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to bearings and seals for vertical shaft style pumps having an overhead bearing assembly (OBA) and an underseal bearing assembly (UBA) wherein an improved, low profile OBA which stabilizes the pump shaft to minimize shaft wobble, thus prolonging seal life, can be installed in the field.

2. General Background of the Invention

Vertical shaft pumps are commercially available pumps (e.g., www.ruitepump.com) that can employ an overhead bearing assembly or OBA and an underseal bearing assembly or UBA.

Vertical shaft pumps that use both an overhead bearing assembly and an underseal bearing assembly are often used in the marine industry such as on barges. In order to remove the underseal bearing assembly or "UBA", the barge or other vessel must typically be taken to a shipyard. This presents extra expense and loss of time to the operator of the vessel.

BRIEF SUMMARY OF THE INVENTION

The present invention provides a method and apparatus for installing an overhead bearing assembly which can be field installed with little or no modifications to the pump itself. The present invention is a low profile apparatus preferably utilizing a straight outer diameter (OD) ball bearing and a piloted register to force the shaft of the pump to center. While straight outer diameter ball bearings are preferred, one could use a spherical OD bearing. Also, one could use a non-piloted version of the bearing (though a piloted register is preferred).

The present invention increases bearing life and allows the overall assembly to be shortened. The shorter assembly allows installation of an overhead bearing assembly and an under seal bearing assembly. The method and apparatus of the present invention enables one unit to cover multiple different configurations. That is, the present invention can be utilized with different kinds of pumps that employ OBAs. Another benefit of the present invention is that it provides a stabilizer arrangement that prevents pump shaft wobble, thus increasing the life of the mechanical seal.

An overhead bearing assembly of the present invention has a lower profile than prior art overhead bearing assemblies. This lower profile is useful due primarily to the existence of an under-seal bearing assembly (UBA) already installed on the pump. Prior art overhead bearing assemblies will not fit on a pump equipped with a UBA and would require removal of the UBA to install. To remove the UBA and install a prior art overhead bearing assembly would require a trip to a shipyard and lift equipment (a crane). The present invention makes it possible to install an OBA in the field. The low profile of the OBA of the present invention is preferably achieved by replacing the spherical OD bearing with a thinner, straight OD bearing. The straight OD bearing is preferred, as it increases the rigidity of the assembly therefore attenuating more run-out and shaft vibration.

Also, the housing containing the OD bearing is preferably also made thinner.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
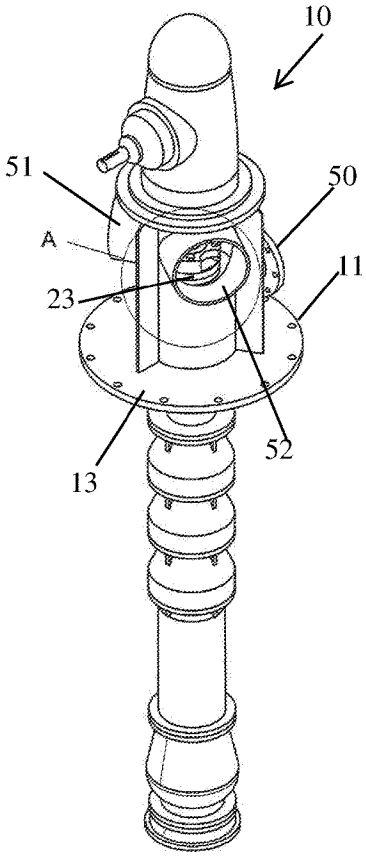
FIG. 1 is an elevation perspective view of a preferred embodiment of the apparatus of the present invention.
Figure 2:
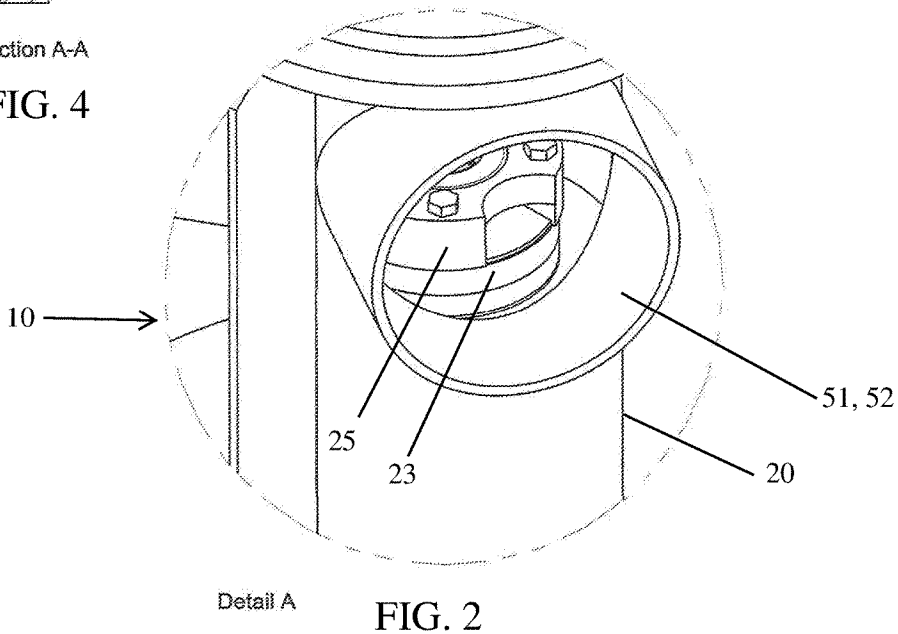
FIG. 2 is a close-up partial perspective view of detail A of FIG. 1 of a preferred embodiment of the apparatus of the present invention.
Figure 4:
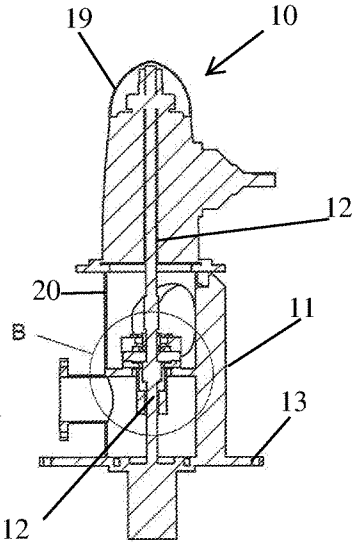
FIG. 4 is a sectional view of a preferred embodiment of the apparatus of the present invention.

FIGS. 1-12 show a preferred embodiment of the apparatus of the present invention designated generally by the numeral 10. Pump and pump bearing apparatus 10 can be a new pump or can be a retrofit to a commercially available pump 11 of the type having pump shaft 12 which is generally vertically positioned (e.g., see FIGS. 1 and 3). In general, such pumps are commonly used in the marine industry (e.g., on barges). Examples of such pumps include Ruhrpumpen, Byron Jackson, Flowserve, Goulds, ERL and other similarly configured vertical turbine pumps. A mounting plate 13 can be provided such as at a ship or barge deck. As seen in FIG.

3, the lower end of the shaft 12 drives an impeller 14 that can be surrounded with strainer 15. The impeller 14 is contained within a casing or impeller housing 16 that is connected to a discharge pipe 17. A mechanical seal 23 is provided (see FIGS. 2, 5, 10, 11, and 12). The maximum thickness of mechanical seal 23 can be between about 1.264 and 1.4 inches. Pump effluent discharges at outlet 50 below seal 23 (see FIG. 1). Openings 51, 52 provide access to seal 23. There can be an under bearing assembly or UBA at 22 (see FIGS. 5, 10-12). Such mechanical seal 23 and under bearing assembly 22 can be seen for example in U.S. Pat. No. 7,699,579 which is hereby incorporated herein by reference.

Figure 3:
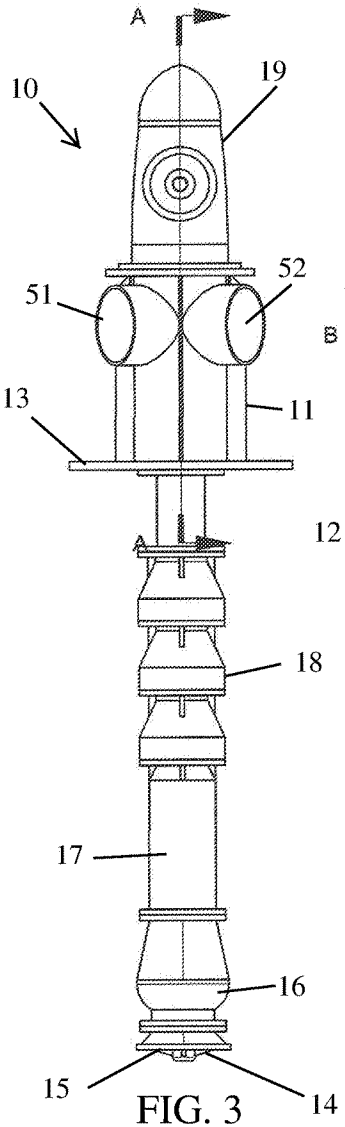
FIG. 3 is an elevation view of a preferred embodiment of the apparatus of the present invention.
Figure 5:
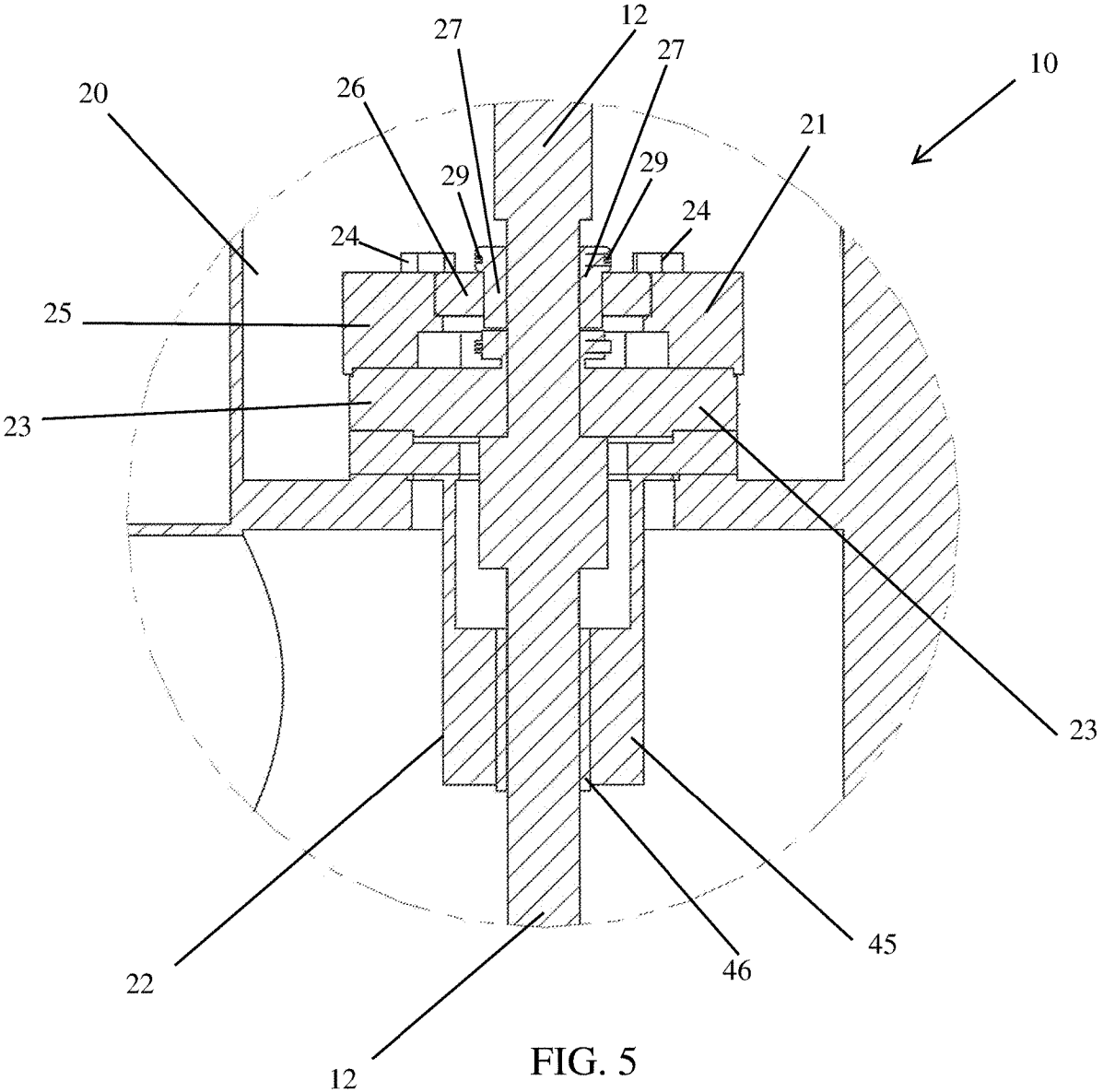
FIG. 5 is an enlarged detailed sectional view of detail B of FIG. 4 of a preferred embodiment of the apparatus of the present invention.
Figure 7:
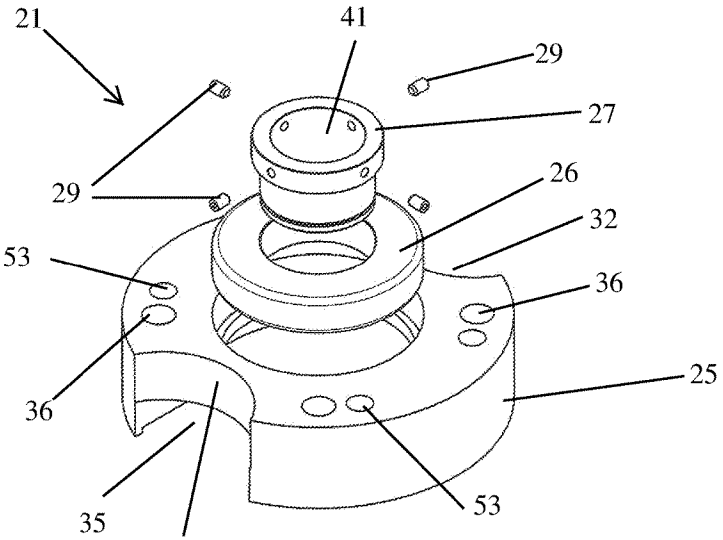
FIG. 7 is a perspective exploded view of a preferred embodiment of the apparatus of the present invention.
Figure 9:
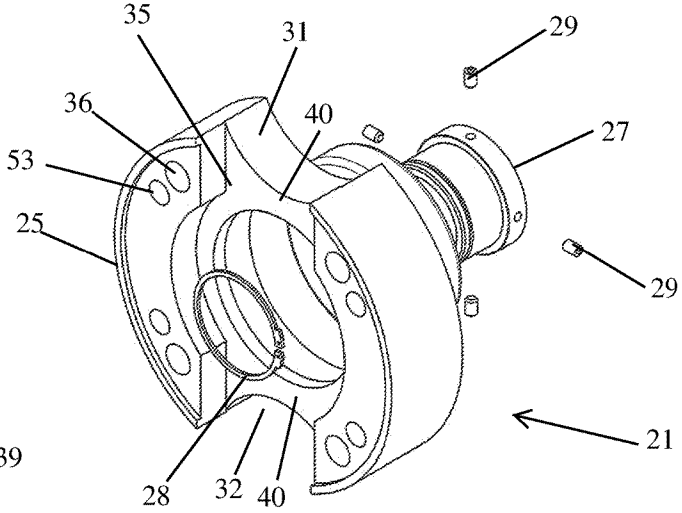
FIG. 9 is a fragmentary view of a preferred embodiment of the apparatus of the present invention.

A column or housing 18 surrounds shaft 12 (see FIG. 3). Housing 18 extends between mounting plate 13 and casing or impeller housing 16. At the upper end portion 19 of pump 11 there is provided bearing housing 20 (see FIG. 4). Bearing housing 20 contains overhead bearing assembly 21 and underseal bearing assembly 22 (see FIG. 5). Openings 51-52 can be in bearing housing 20.

Overhead bearing assembly can be made of stainless steel, steel or brass, for example. When made of stainless steel, one could use 303 Stainless Steel (or 304, or 316, or 17-4 Stainless Steel), for example.

The apparatus 10 of the present invention features an adapter housing 25 which carries ball bearing 26, sleeve 27 and retaining ring 28 (see FIGS. 6-9). Adapter housing 25 can be made of stainless steel, steel or brass, for example. When made of stainless steel, one could use 303 Stainless Steel (or 304, or 316, or 17-4 Stainless Steel). Ball bearing 26 can be a high capacity ball bearing, for example. Sleeve 27 has sleeve central opening 41 that is occupied by pump shaft 12. Sleeve 27 is held in position on shaft 12 with multiple set screws 29. Sleeve 27 has annular groove 30 that is receptive of retaining ring 28. Sleeve 27 also has annular shoulder 44. Bearing 26 (e.g., ball bearing) is secured between annular shoulder 44 and retaining ring 28. Side portions 33, 34 each can provide one or more pairs of openings 36, 53. The openings can be different to facilitate use on multiple pumps. For example, one set of openings, 36, could be a ⅝" bolt hole pattern 6.5" bolt circle for use with Ruhrpumpen, Byron Jackson, and ERL design pumps. Another set of openings, 53, could be a ½" bolt hole pattern 6.5" bolt circle for use with Goulds pumps. Although the figures present different embodiments showing either both openings 36, 53 or only openings 36, the present invention can include embodiments of either or both type of openings. Arc shaped recesses 31, 32 allow easier access to the set screws (seal driver set screws) 29. Recesses 31, 32 can be other shapes instead of arc shaped, but the arc-shaped recesses are less expensive to install and provide greater strength of the overall unit. Laterally extending space or recess 35 also allows easier access to the seal driver set screws 29. Openings 36 are bolt hole openings that enable a bolted connection (e.g., bolts 24, FIG. 5) of adapter housing 25 to mechanical seal 23.

Figure 6:
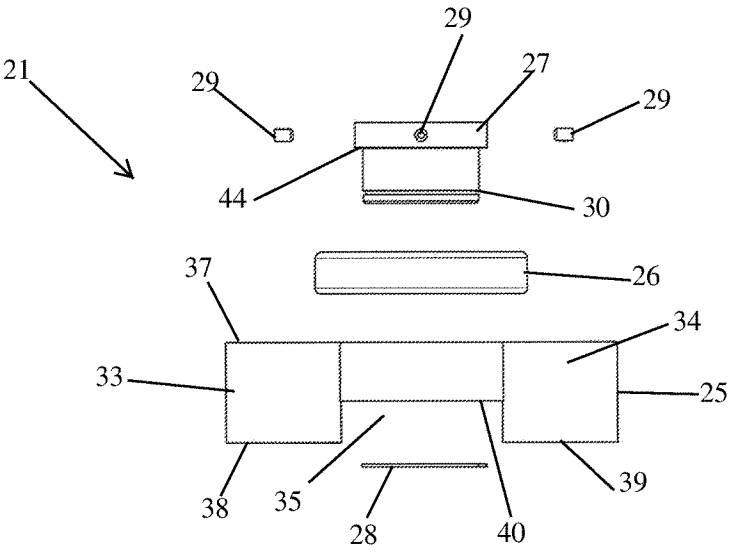
FIG. 6 is an exploded perspective view taken along lines A-A of FIG. 3.
Figure 8:
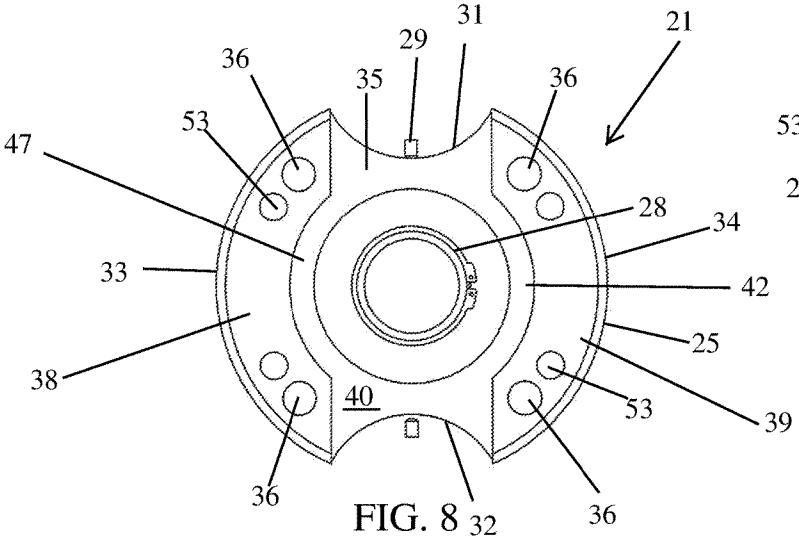
FIG. 8 is a fragmentary view of a preferred embodiment of the apparatus of the present invention.
Figure 10:
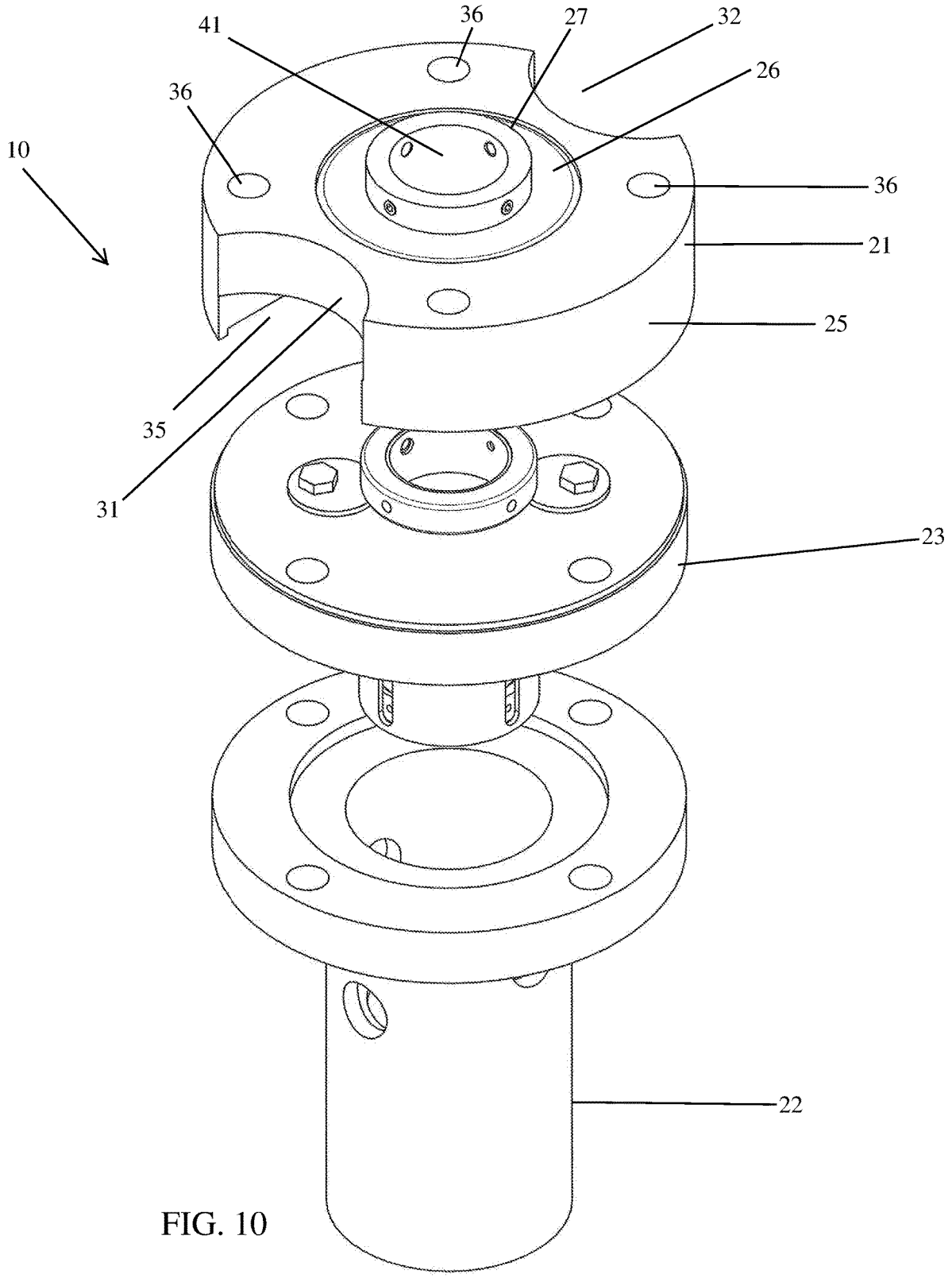
FIG. 10 is an exploded view of a preferred embodiment of the apparatus of the present invention.
Figure 11:
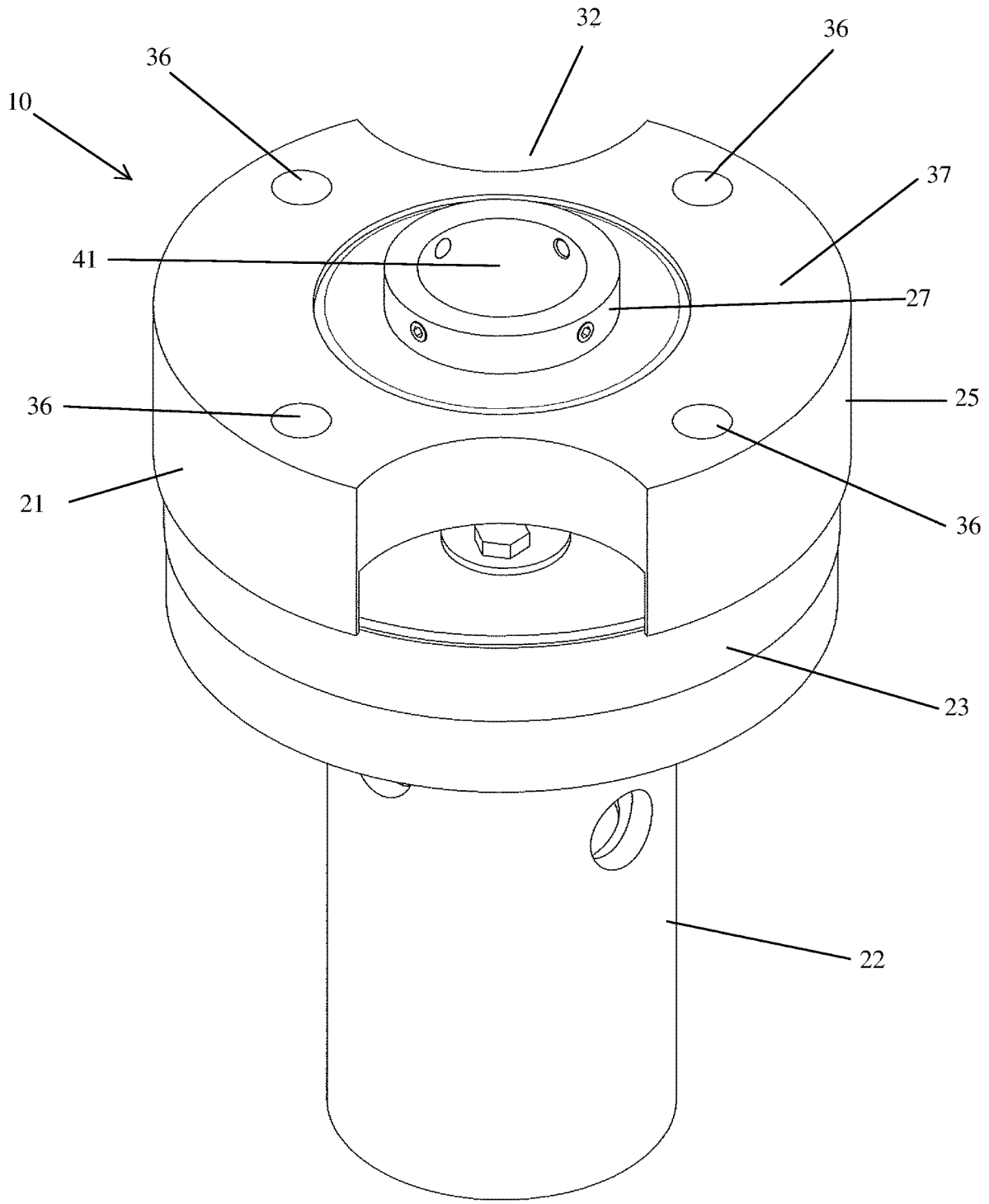
FIG. 11 is a perspective view of a preferred embodiment of the apparatus of the present invention.
Figure 12:
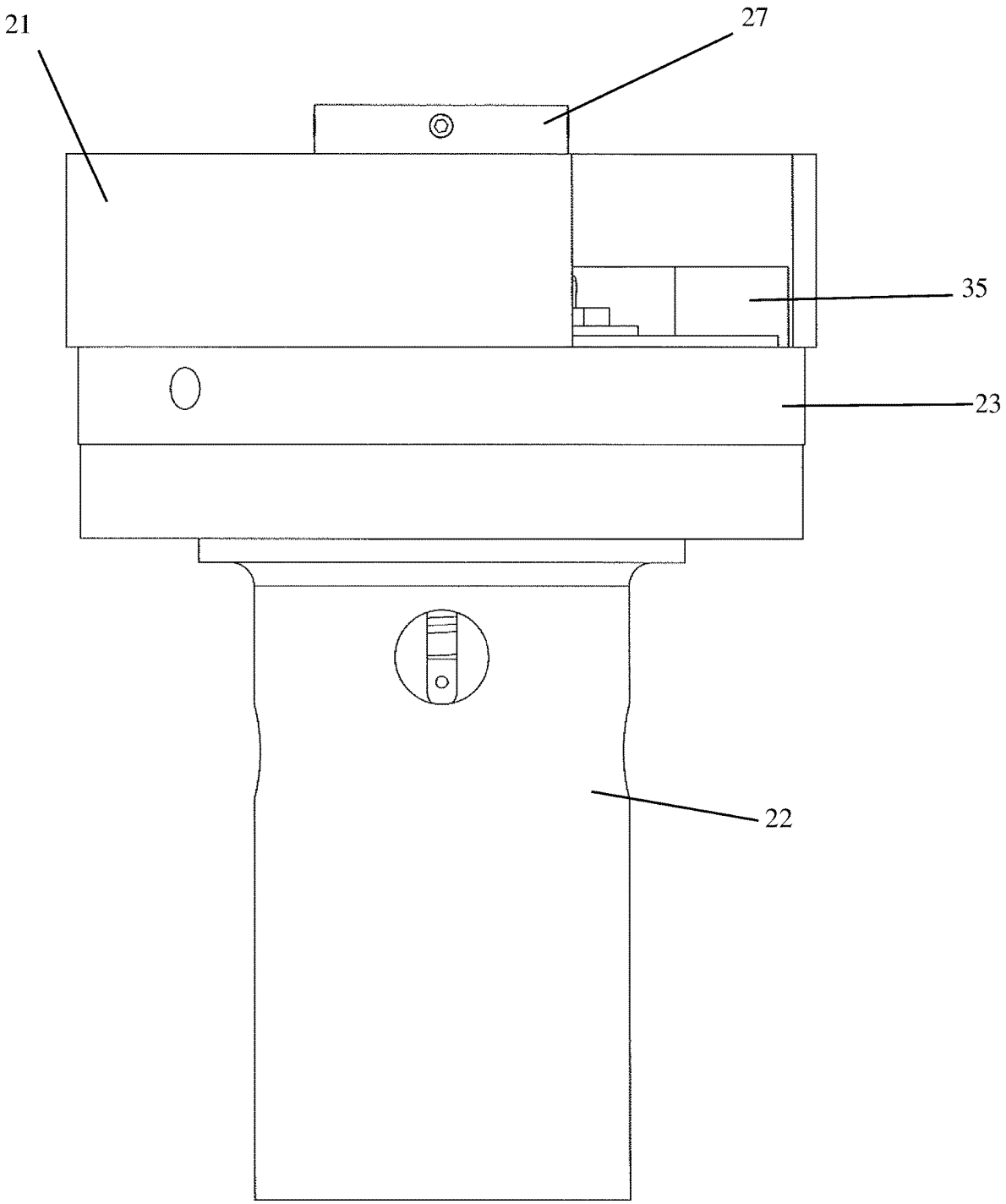
FIG. 12 is a side view of a preferred embodiment of the apparatus of the present invention.

Adaptor housing 25 has upper surface 37 and lower surfaces 38, 39. Lower surfaces 38, 39 are lower than surface 40 as seen in FIG. 6. The surface 40 extends laterally from one arcuate recess 31 to the other arcuate recess 32 as seen in FIGS. 6-9. Surface 40 includes curved sections at 42, 47. A cylindrically shaped socket 43 is provided in adapter housing 25. Cylindrically shaped socket 43 is receptive of bearing 26 and sleeve 27 upon assembly. The assembled position of socket 43, bearing 26 and sleeve 27 is seen in FIGS. 6-12. Lower bearing seal 22 includes bushing 46 which fits around shaft 12 and housing 45 which fits bushing 46. Bushing 46 is thus an interface between shaft 12 and housing 45. Bushing 46 can be a cylindrical sleeve of stainless steel material. Bushing 46 could also be made of steel or brass, for example.

The low profile OBA of the present invention can be configured to fit the common pump shaft sizes of 1 7/16", 1½", and 1 15/16". One can also, by producing a custom center sleeve, fit any shaft size 2" or smaller, for example. Larger sizes could also be made, though it is unlikely that a shaft would be larger than 3".

When used with most pumps, the adapter housing of the overhead bearing assembly of the present invention preferably has a thickness of less than 3", and more preferably less than 2.75". The adapter housing of the overhead bearing assembly can have a thickness of between about 2.25" and 2.5", for example. Thickness refers to the height of the housing when the OBA is properly installed in a pump with a vertical shaft.

Bolts and screws can be made of, for example, stainless steel, or steel but stainless is preferred. When made of stainless steel, one could use 303 Stainless Steel (or 304, or 316, or 17-4 Stainless Steel), for example.

The following is a list of parts and materials suitable for use in the present invention:

PARTS LIST

Part Number Description

10 pump bearing assembly/apparatus
11 pump
12 pump shaft
13 mounting plate
14 impeller
15 strainer
16 casing/impeller housing
17 discharge pipe
18 column/housing
19 upper end portion
20 bearing housing
21 overhead bearing assembly (preferably less than 5" high, more preferably less than 4" high, and even more preferably less than 3" high—for example, it can be 2.561" high)
22 under bearing assembly/lower bearing seal
23 mechanical seal
24 bolt
25 adapter housing (preferably 2-10" in diameter, more preferably 3-9" in diameter, and most preferably 4-9" in diameter (typically about 8" in diameter); preferably less than 4" high, more preferably less than 3" high, and even more preferably less than 2.5" high—for example, it can be 2.047" high)
26 bearing/ball bearing
27 sleeve (preferably less than 3" high, more preferably less than 2" high, and even more preferably less than 1" high—for example. 0.514" high)
28 retaining ring
29 set screw/seal set screw/seal driver set screw
30 annular groove
31 arcuate recess
32 arcuate recess
33 side portion
34 side portion
35 laterally extending space (preferably at least 0.25" high, more preferably at least 0.5" high, and most preferably at least 0.8" high—for example, it can be 0.85" high)

36 opening
37 upper surface
38 surface
39 surface
40 surface
41 sleeve central opening (preferably the same diameter as the shaft for which it will be used)
42 curved portion
43 cylindrically shaped socket
44 annular shoulder
45 UBA housing
46 UBA bushing
47 curved portion
50 discharge outlet
51 access opening
52 access opening
53 opening The foregoing embodiments are presented by way of example only; the scope of the present invention is to be limited only by the following claims.

The invention claimed is:

1. A pump and pump bearing apparatus, comprising:
a pump having a pump housing and a vertically positioned pump drive shaft;
the pump housing connecting to a horizontally extending deck plate;
an overhead bearing assembly;
an underseal bearing assembly below the overhead bearing assembly;
a mechanical seal that seals around the shaft in between the overhead bearing assembly and underseal bearing assembly;
wherein the pump drive shaft extends through the said overhead and underseal bearing assemblies and through the mechanical seal;
an impeller driven by the pump shaft and positioned below the said deck plate; and
said overhead bearing assembly having an adapter housing with a peripheral portion and including one or more recesses that each communicate with said peripheral portion; and
said adapter housing having opposed lower most bearing surfaces that rest upon said mechanical seal.

2. The apparatus of claim 1 wherein said adapter housing has a transverse recess in between said lower most bearing surfaces.

3. The apparatus of claim 1 wherein the overhead bearing assembly includes a ball bearing housed within said adapter housing.

4. The apparatus of claim 3 wherein the overhead bearing assembly includes a sleeve that attaches to the adapter housing.

5. The apparatus of claim 4 wherein the ball bearing has an inner diameter that is sized and shaped to receive and connect with the sleeve.

6. The apparatus of claim 5 wherein the sleeve has an annular groove, and further comprising a retaining ring that is removably connectable to the sleeve at said annular groove.

7. The apparatus of claim 6 wherein the sleeve has an annular shoulder opposite said annular groove and wherein the ball bearing is located in between the annular shoulder and the retaining ring.

8. A pump bearing apparatus, comprising:
a pump having a pump housing, a mechanical seal, and a vertically positioned pump drive shaft;
an overhead bearing assembly attached to the pump drive shaft;
an underseal bearing assembly positioned below the mechanical seal and the overhead bearing assembly and sealing against the pump drive shaft;
the mechanical seal sealing around the pump drive shaft in between the overhead bearing assembly and underseal bearing assembly;
the overhead bearing assembly having an adapter housing;
wherein the pump drive shaft extends through the said overhead and underseal bearing assemblies, through the mechanical seal and through said adapter housing;
an impeller driven by the pump shaft; and
said adapter housing having opposed lower most bearing surfaces that rest upon said mechanical seal and a transverse recess in between said lower most bearing surfaces.

9. The apparatus of claim 8 wherein the adapter housing has a periphery and a pair of spaced apart arc shaped recesses located at said periphery.

10. The apparatus of claim 9 wherein the transverse recess that extends from one said arc shaped recess to the other arc shaped recess.

11. The apparatus of claim 9 wherein said arc shaped recesses are located 180 degrees apart.

12. The apparatus of claim 8 wherein the mechanical seal has a maximum thickness of between 1.264" and 1.4".

13. An overhead bearing assembly for a pump having:
a pump housing and a vertically positioned pump drive shaft;
the pump housing connecting to a horizontally extending deck plate;
a mechanical seal that seals around the shaft;
an underseal bearing assembly below the mechanical seal;
an impeller driven by the pump shaft and positioned below the said deck plate;
wherein the pump drive shaft extends through the underseal bearing assembly and through the mechanical seal;
the overhead bearing assembly comprising:
an adapter housing with a peripheral portion and including one or more recesses that each communicate with said peripheral portion; and
said adapter housing having opposed lower most bearing surfaces that rest upon said mechanical seal.

14. The overhead bearing assembly of claim 13 wherein the overhead bearing assembly includes a ball bearing housed within said adapter housing.

15. The overhead bearing assembly of claim 14 wherein the overhead bearing assembly includes a sleeve that attaches to the adapter housing.

16. The overhead bearing assembly of claim 15 wherein the ball bearing has an inner diameter that is sized and shaped to receive and connect with the sleeve.

17. The overhead bearing assembly of claim 16 wherein the sleeve has an annular groove, and further comprising a retaining ring that is removably connectable to the sleeve at said annular groove.

18. The overhead bearing assembly of claim 17 wherein the sleeve has an annular shoulder opposite said annular groove and wherein the ball bearing is located in between the annular shoulder and the retaining ring.

* * * * *